US005625927A

United States Patent [19]

Chu

[11] Patent Number: 5,625,927

[45] Date of Patent: May 6, 1997

[54] SLIDER OF A ZIPPER

[76] Inventor: Tino Chu, No. 95, Chien Cheng Street, Chien Cheng, Kaoshiung, Taiwan

[21] Appl. No.: 545,510

[22] Filed: Oct. 19, 1995

[51] Int. Cl.[6] ..... A44B 19/26; A44B 19/30

[52] U.S. Cl. ..... 24/421; 24/415; 24/418

[58] Field of Search ..... 24/386, 387, 418, 24/415, 420, 421, 424, 436

[56] References Cited

U.S. PATENT DOCUMENTS

| | | | |
|---|---|---|---|
| 3,602,958 | 9/1971 | Glindmeyer | 24/421 |
| 4,578,966 | 4/1986 | Kasai | 24/418 X |
| 4,624,032 | 11/1986 | Ishii et al. | 24/437 X |
| 4,823,447 | 4/1989 | Akashi | 24/421 X |
| 5,167,052 | 12/1992 | Aoki et al. | 24/421 |
| 5,400,481 | 3/1995 | Oda | 24/424 |

*Primary Examiner*—Peter M. Cuomo
*Assistant Examiner*—Robert J. Sandy
*Attorney, Agent, or Firm*—Bucknam and Archer

[57] ABSTRACT

A slider of a zipper including a slider body having a sliding slot for passing the interlocking tabs, a U-shaped nose raised from the top wall of the slider body, a pin hole through the top wall of the slider body, and a blind hole on the top wall, the nose having one end adjacent to the pinhole in the top wall of the slider body, an opposite end spaced from the top wall of the slider body by a gap, a first through hole through said nose in alignment with said gap and said blind hole, and a second through hole intersecting said first through hole; a spring mounted inside the blind hole; a movable block inserted into the blind hole and supported on the spring, having a beveled front end disposed in the gap; a spring locating plate mounted in between the slider body and the nose, having a transverse slot at one end disposed in the second through hole, and a pair of projections at an opposite end disposed in the pin hole and moved into engagement with the interlocking tabs; and a stop plate mounted inside the first through hole and inserted through the transverse slot of the spring locating plate, having a downwardly backward projecting strip stopped against the springy locating plate to limit backward movement of the stop plate relative to the spring locating plate.

1 Claim, 3 Drawing Sheets

SLIDER OF A ZIPPER

BACKGROUND OF THE INVENTION

The present invention relates to zippers, and relates more particularly to a slider of a zipper.

Various zippers have been disclosed for closing/opening the opening of a garment or bag, and have appeared on the market. Conventional zippers commonly consist of two rows of metal or plastic tabs (teeth) on strips of tape for binding to the edges of an opening (as of a garment or bag) and having a slider that closes the opening by drawing the tabs into interlocking position. Different zippers may have different sliders. For use in closing a horizontal opening on a bag, suitcase, etc., the slider can be a non lock slider; for use in closing a vertical opening of a garment, the slider can be a pin lock, spring lock, or autolock slider. Regular spring lock or autolock sliders are commonly complicated in structure. During the processing of a spring lock or autolock slider, a cup and a puller must be forced into the slider body by a special machine. The complicated manufacturing process of regular spring lock and autolock sliders greatly increases the manufacturing cost.

SUMMARY OF THE INVENTION

The present invention has been accomplished to provide a slider of a zipper which is simple in structure, easy and inexpensive to manufacture. According to the preferred embodiment, the slider comprises a slider body having a sliding slot for passing the interlocking tabs, a U-shaped nose raised from the top wall of the slider body, a pin hole through the top wall of the slider body, and a blind hole on the top wall, the nose having one end adjacent to the pin hole in the top wall of the slider body, an opposite end spaced from the blind hole in the top wall of the slider body by a gap, a first through hole through said nose in alignment with said gap and said blind hole, and a second through hole intersecting said first through hole; a spring mounted inside the blind hole; a movable block inserted into the blind hole and supported on the spring, having a beveled front end disposed in the gap; a spring locating plate mounted in between the slider body and the nose, having a transverse slot at one end disposed in the second through hole, and a pair of projections at an opposite end disposed in the pin hole and moved into engagement with the interlocking tabs; and a stop plate mounted inside the first through hole and inserted through the transverse slot of the spring locating plate, having a downwardly backward projecting strip stopped against the spring locating plate to limit backward movement of the stop plate relative to the springy locating plate.

DETAILED DESCRIPTION OF THE PREFERRED EMBODIMENT

Figure 1:
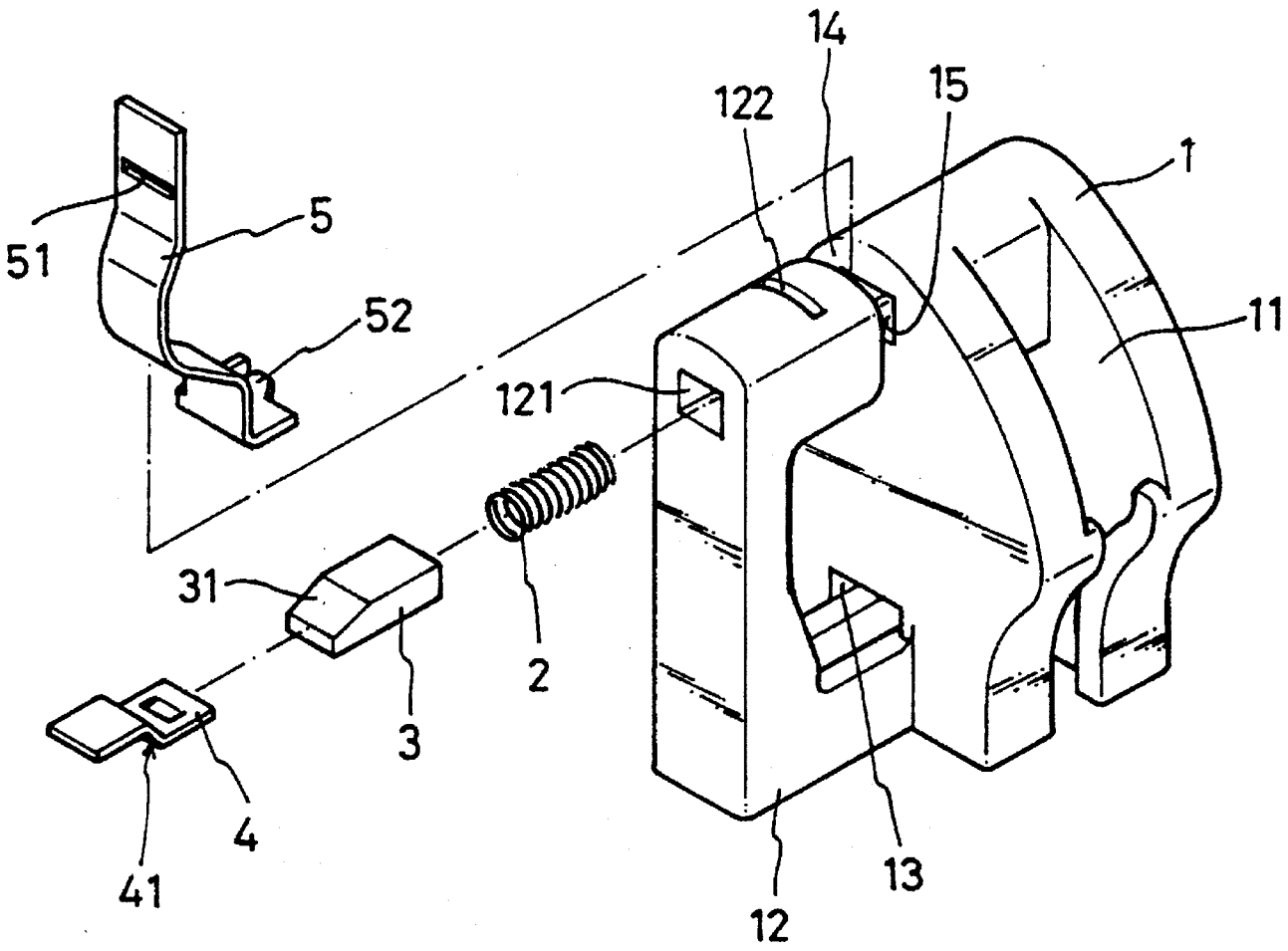
FIG. 1 is an exploded view of slider according to the present invention.
Figure 2:
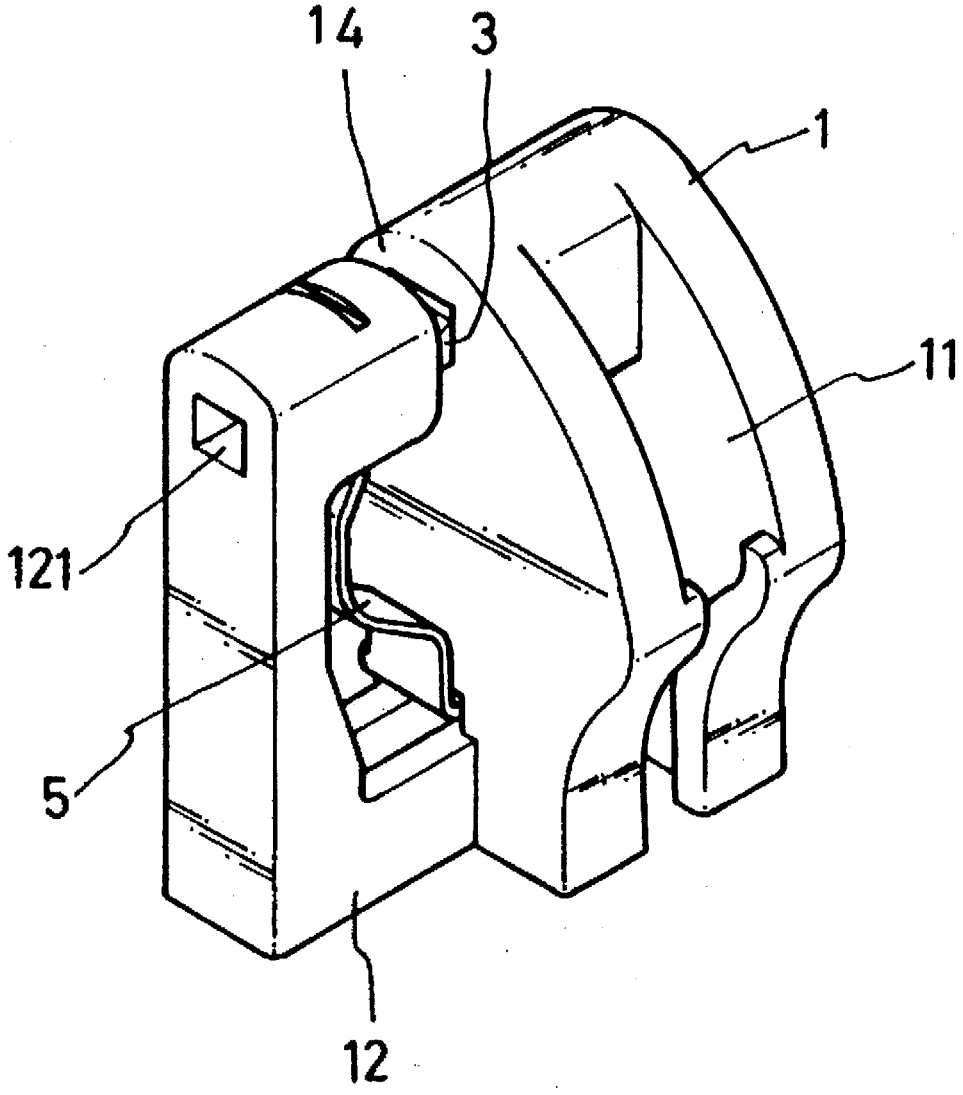
FIG. 2 is an elevational view of the slider shown in FIG. 1.
Figure 3:
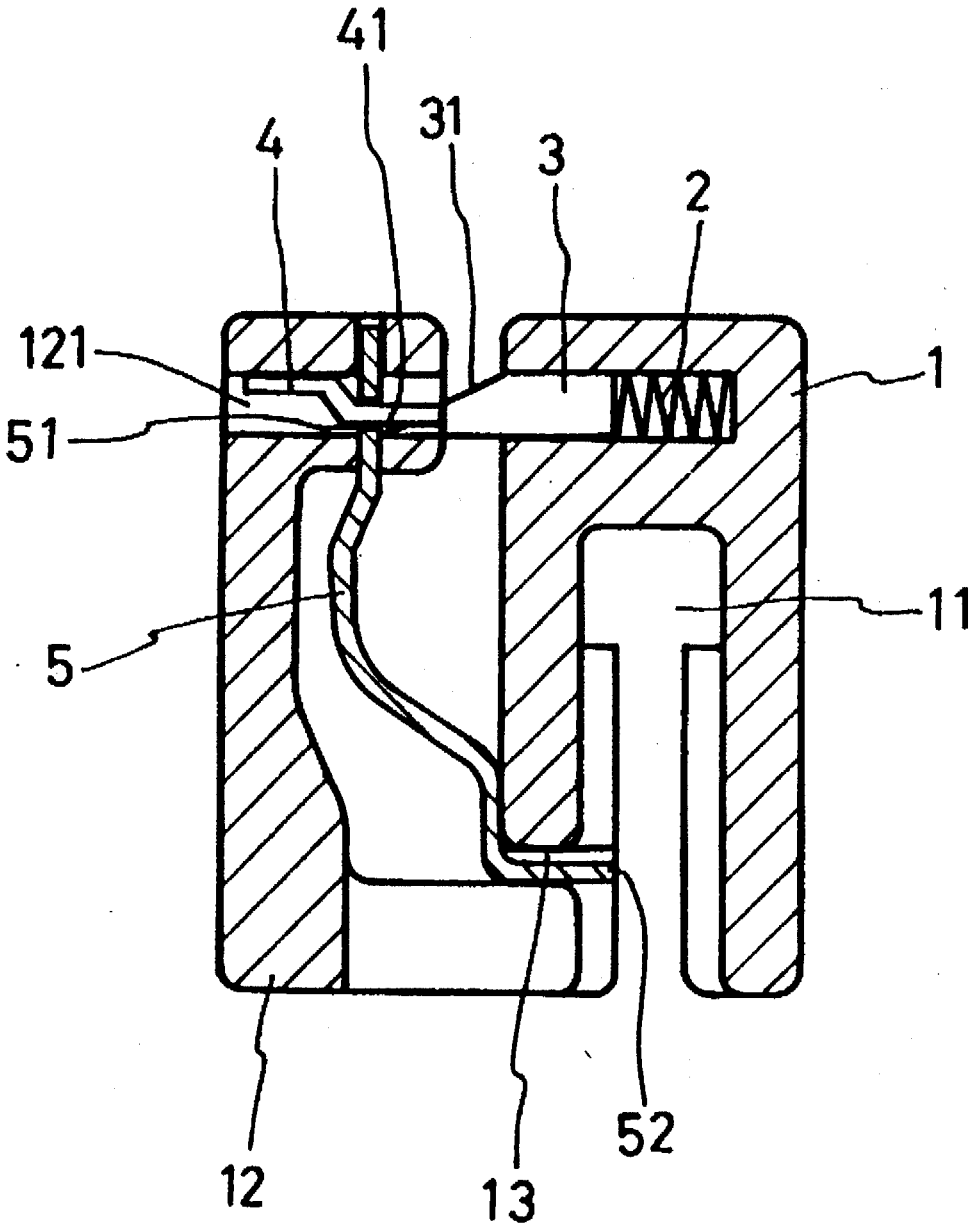
FIG. 3 is a front view in section of FIG. 2.

Referring to FIGS. 1, 2, and 3, a slider in accordance with the present invention is generally comprised of a body 1, a spring 2, a movable block 3, a stop plate 4, and a spring locating plate 5. The body 1 comprises a sliding slot 11 for passing the interlocking tabs, a substantially U-shaped nose 12 raised from the top side thereof, a pin hole 13 through the top side adjacent to one end of the nose 12, a gap 14 defined between the opposite end of the nose 12 and the top side of the body 1, a blind hole 15 on the top side, a first through hole 121 through the nose 12 in alignment with the blind hole 15 but separated from it by the gap 14, and a second through hole 122 intersecting the first through hole 121. The spring 2 is mounted inside the blind hole 15. The movable block 3 is partially inserted into the blind hole 15 and supported on the spring 3, having a beveled front end 31 disposed outside the blind hole 15. The spring locating plate 5 is mounted in between the body 1 and the nose 12 with its two opposite ends respectively inserted into the second through hole 122 of the nose 12 and the pin hole 13 of the body 1, having a transverse slot 51 disposed inside the second through hole 122 of the nose 12, and a pair of projections 52 disposed in a parallel relation for engagement into the gaps of the interlocking tabs. The stop plate 4 is mounted inside the first through hole 121 of the nose 12 and inserted through the transverse slot 51 of the spring locating plate 5, having a downwardly backward projecting strip 41 stopped against the spring locating plate 5 (see FIG. 3).

Referring to FIGS. 2 and 3, when the spring 2 and the movable block 3 are respectively inserted into the blind hole 15, the spring locating plate 5 is inserted through the second through hole 122 of the nose 12 into the pin hole 13 of the body 1, then the stop plate 4 is inserted into the first through hole 121 of the nose 12 and the transverse slot 51 of the spring locating plate 5. When the downwardly backward projecting strip 41 of the stop plate 4 passes through the transverse slot 51 of the spring locating plate 5, the stop plate 4 is immediately forced backwards by the spring 2 through the movable block 3, causing the downwardly backward projecting strip 41 to stop against the spring locating plate 5, and therefore the stop plate 4 is retained to the spring locating plate 5. When the puller (not shown) is inserted into the gap 14 to give a pressure to the beveled front end 31 of the movable block 3, the movable block is forced backwards to compress the spring 2 for letting the puller pass and be further coupled to the nose 12. When the puller passes through the gap 14 and coupled to the nose 12, the spring 2 immediately forces the movable block 3 back to its former position to stop against the stop plate 4 and to close the gap 14 again. When the puller is pulled, the spring locating plate 5 is deformed to release the projections 52 away from the interlocking tabs of the zipper. When the puller is released, the spring locating plate 5 returns to its former shape to force the projections 52 into engagement with the interlocking tabs of the zipper.

It is to be understood that the drawings are designed for purposes of illustration only, and are not intended as a definition of the limits and scope of the invention disclosed.

I claim:

1. A slider for installation in a zipper having interlocking tabs and pulled by a puller of the zipper to close/open the interlocking tabs, comprising:

a slider body having a sliding slot for passing the interlocking tabs of the zipper and a top wall, a substantially U-shaped nose raised from said top wall, a pin hole through said top wall in communication with said sliding slot, and a blind hole on said top wall, said nose having one end adjacent to the pin hole in said top wall, an opposite end spaced from said top wall by a gap, a first through hole through said nose in alignment with said gap and said blind hole, and a second through hole intersecting said first through hole;

a spring mounted inside said blind hole;

a movable block inserted into said blind hole and supported on said spring, having a beveled front and disposed in said gap;

a spring locating plate mounted in between said slide body and said nose, having a first end inserted into said second through hole, a transverse slot at said first end, a second end inserted into said pin hole, and a pair of projections at said second end for engagement with the interlocking tabs of the zipper; and a stop plate mounted inside said first through hole and inserted through the transverse slot of said spring locating plate, having a downwardly backward projecting strip stopped against said spring locating plate to limit backward movement of said stop plate relative to said spring locating plate.

* * * * *